US005416456A

United States Patent [19]

Light

[11] Patent Number: 5,416,456

[45] Date of Patent: May 16, 1995

[54] MAGNETIC SWITCH ASSEMBLIES FOR HOME SECURITY SYSTEMS

[76] Inventor: Randy Light, P.O. Box 832, Georgetown, Tex. 78627

[21] Appl. No.: 188,684

[22] Filed: Jan. 31, 1994

[51] Int. Cl.[6] ..... H01H 9/00

[52] U.S. Cl. ..... 335/205; 335/206

[58] Field of Search ..... 335/205, 206, 207; 340/547

[56] References Cited

U.S. PATENT DOCUMENTS

| | | | |
|---|---|---|---|
| 4,292,629 | 9/1981 | Kerr et al. | 340/547 |
| 4,700,163 | 10/1987 | Wolfe, Jr. | 335/205 |
| 4,999,599 | 3/1991 | Spier | 335/207 |

*Primary Examiner*—Lincoln Donovan

[57] ABSTRACT

Apparatus for detecting the opened and closed state of a window as a component of a home security system comprising of a window having a peripheral frame defining an opening with a lower sill having a free upper surface thereof and an associated window slidable within the opening between an upper open orientation and a lower closed orientation, the window having a free lower surface adaptable to be in operative contact with the upper surface of the sill when the window is closed. A magnetically responsive switch secured with respect to the upper surface of the sill, the switch having a moveable component and a fixed component with a pair of electrical leads, one of the leads electrically coupled between the fixed component and the other lead electrically coupled to the moveable component, the moveable component being in an orientation out of contact with the fixed component when the window is opened but moveable under the influence of a magnetic force into contact with the fixed component when the window is closed, the fixed and moveable components being formed of electrically conductive material whereby when moved into contact one with another an electrical circuit will be closed to send a signal that the window is closed but when moved out of contact one with another an electrical circuit will be opened to send a signal that the window is opened. A moveable switch actuator formed as a magnet secured to the lower surface of the window with securement means to secure the magnet in position to the lower surface of the window whereby when the window was opened the magnetic field is removed from the switch but when the window is closed the magnet will, magnetically raise the second component of the switch into contact with the first component of the switch, the securement means including regions coupled to the bottom of the window and regions for holding the exterior surface of the magnet in an appropriate orientation with respect to the bottom of the window and the sill.

9 Claims, 4 Drawing Sheets

FIG 5
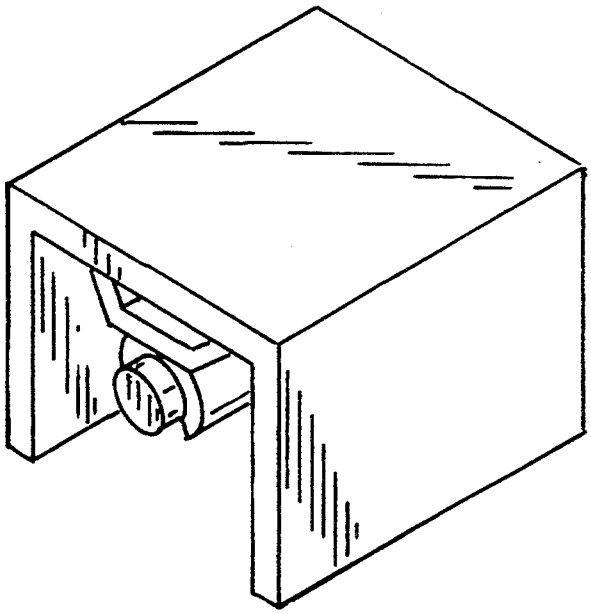
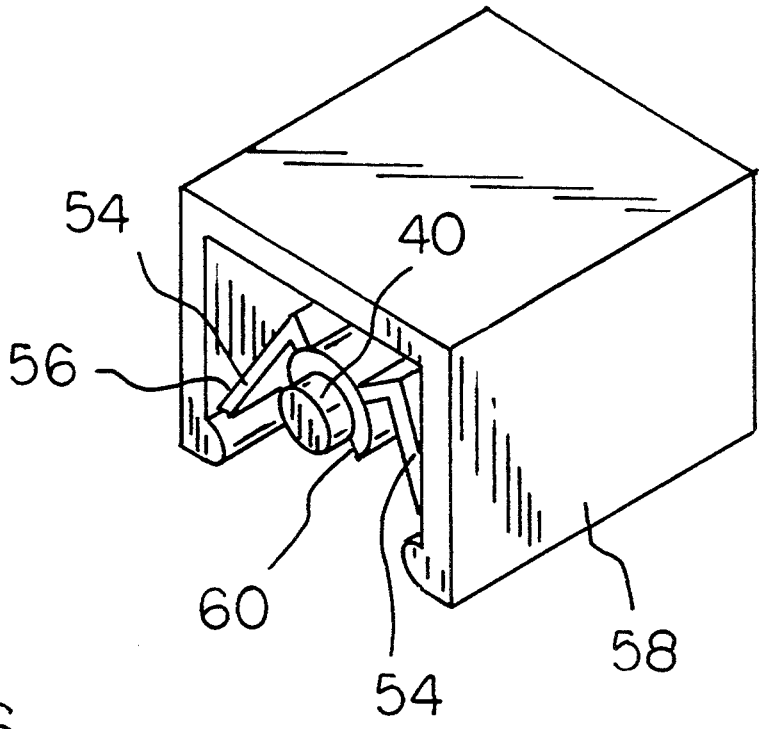
FIG 6

MAGNETIC SWITCH ASSEMBLIES FOR HOME SECURITY SYSTEMS

BACKGROUND OF THE INVENTION

1. Field of the Invention

The present invention relates to switch magnetic assemblies for home security systems and more particularly pertains to switches with magnets for security systems in windows.

2. Description of the Prior Art

The use of security systems is known in the prior art. More specifically, components for security systems heretofore devised and utilized for the purpose of rendering security systems more reliable are known to consist basically of familiar, expected and obvious structural configurations, notwithstanding the myriad of designs encompassed by the crowded prior art which have been developed for the fulfillment of countless objectives and requirements.

The prior art for example shows various techniques for securing a magnet with regard to a window or door. Note U.S. Pat. No. 5,044,050 to Trinkaus which discloses a clip having an electrical lead, the clip being resiliently urged to hold a cylindrical magnet.

U.S. Pat. No. 4,990,898 to Gerese discloses a security system for a door having a strip adjacent to a vertical casing for the door adapted to determine whether the door is open or closed.

U.S. Pat. No. 3,634,845 to Colman discloses a complex arrangement of electrical components on the lower edge of a window with components extending forwardly and rearwardly thereof.

U.S. Pat. No. 5,007,199 to Dunagan discloses a large cumbersome array of components on a pivotable window to determine whether the window is opened or closed.

Lastly, U.S. Pat. No. 5,083,110 to Ahrens discloses a sliding window with detector components at various locations around the sash of a window.

In this respect, the security systems according to the present invention substantially departs from the conventional concepts and designs of the prior art, and in so doing provides an apparatus primarily developed for the purpose of rendering security systems more reliable.

Therefore, it can be appreciated that there exists a continuing need for new and improved security systems. In this regard, the present invention substantially fulfills this need.

SUMMARY OF THE INVENTION

In view of the foregoing disadvantages inherent in the known types of magnetic holders now present in the prior art, the present invention provides an improved security system. As such, the general purpose of the present invention, which will be described subsequently in greater detail, is to provide a new and improved security system and method which has all the advantages of the prior art and none of the disadvantages.

To attain this, the present invention essentially comprises apparatus for detecting the opened and closed state of a window as a component of a home security system comprising, in combination, a window apparatus for detecting the opened and closed state of a window as a component of a home security system comprising, in combination of a window having a peripheral frame defining an opening with a lower sill having a free upper surface thereof and an associated window slidable within the opening between an upper open orientation and a lower closed orientation, the window having a free lower surface adaptable to be in operative contact with the upper surface of the sill when the window is closed. A magnetically responsive switch secured with respect to the upper surface of the sill, the switch having a moveable component and a fixed component with a pair of electrical leads, one of the leads electrically coupled between the fixed component and the other lead electrically coupled to the moveable component, the moveable component being in an orientation out of contact with the fixed component when the window is opened but moveable under the influence of a magnetic force into contact with the fixed component when the window is closed, the fixed and moveable components being formed of electrically conductive material whereby when moved into contact one with another an electrical circuit will be closed to send a signal that the window is closed but when moved out of contact one with another an electrical circuit will be opened to send a signal that the window is opened. A moveable switch actuator formed as a magnet secured to the lower surface of the window with resilient means to secure the magnet in position to the lower surface of the window whereby when the window is opened the magnetic field is removed from the switch but when the window is closed the magnet will, magnetically raise the second component of the switch into contact with the first component of the switch, the resilient means including regions coupled to the bottom of the window and regions formed in an arcuate configuration for holding the exterior surface of the magnet in an appropriate orientation with respect to the bottom of the window and the sill.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved magnetic switch assembly for home security systems which has all the advantages of the prior art magnet holders and none of the disadvantages.

It is another object of the present invention to provide a new and improved magnetic switch assemblies for security system which may be easily and efficiently manufactured and marketed.

It is a further object of the present invention to provide a new and improved magnetic switch assemblies for home security systems which is of a durable and reliable construction.

An even further object of the present invention is to provide a new and improved magnetic switch assemblies for home security systems which is susceptible of a low cost of manufacture with regard to both materials and labor, and which accordingly is then susceptible of low prices of sale to the consuming public, thereby making such security systems economically available to the buying public.

Still yet another object of the present invention is to provide a new and improved magnetic switch assemblies for home security systems which provides in the apparatuses and methods of the prior art some of the advantages thereof, while simultaneously overcoming some of the disadvantages normally associated therewith.

Still another object of the present invention is to removably hold magnets reliably, conveniently and economically for rendering security systems more reliable in use and more convenient for installing.

Yet another object of the present invention is to improve the operation and installation of security systems.

Even still another object of the present invention is to provide a new and improved apparatus for detecting the opened and closed state of a window as a component of a home security system comprising apparatus for detecting the opened and closed state of a window as a component of a home security system comprising, a window apparatus for detecting the opened and closed state of a window as a component of a home security system comprising of a window having a peripheral frame defining an opening with a lower sill having a free upper surface thereof and an associated window slidable within the opening between an upper open orientation and a lower closed orientation, the window having a free lower surface adaptable to be in operative contact with the upper surface of the sill when the window is closed. A magnetically responsive switch secured with respect to the upper surface of the sill, the switch having a moveable component and a fixed component with a pair of electrical leads, one of the leads electrically coupled between the fixed component and the other lead electrically coupled to the moveable component, the moveable component being in an orientation out of contact with the fixed component when the window is opened but moveable under the influence of a magnetic force into contact with the fixed component when the window is closed, the fixed and moveable components being formed of electrically conductive material whereby when moved into contact one with another an electrical circuit will be closed to send a signal that the window is closed but when moved out of contact one with another an electrical circuit will be opened to send a signal that the window is opened. A moveable switch actuator formed as a magnet secured to the lower surface of the window with securement means to secure the magnet in position to the lower surface of the window whereby when the window was opened the magnetic field is removed from the switch but when the window is closed the magnet will, magnetically raise the second component of the switch into contact with the first component of the switch, the securement means including regions coupled to the bottom of the window and regions for holding the exterior surface of the magnet in an appropriate orientation with respect to the bottom of the window and the sill.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 illustrates an alternate embodiment for supporting the cylindrical magnet of the magnetic assembly.

FIG. 6 illustrates another alternate embodiment for supporting the cylindrical magnet of the magnetic assembly.

DESCRIPTION OF THE PREFERRED EMBODIMENT

Figure 1:
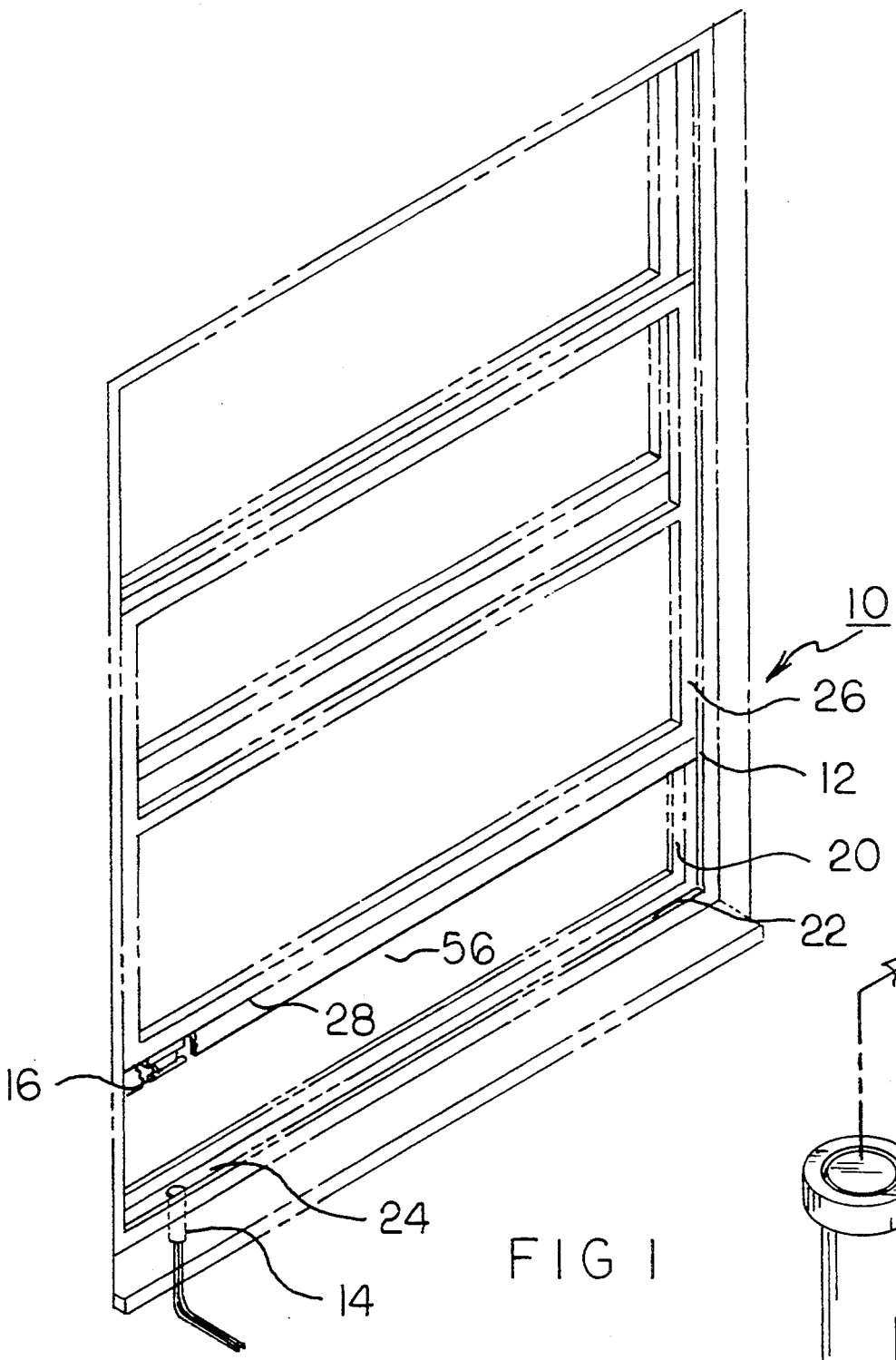
FIG. 1 is a perspective view of a window and associated components construction in accordance with the principles of the present invention.

With reference now to the drawings, and in particular to FIG. 1 thereof, a new and improved security systems embodying the principles and concepts of the present invention and generally designated by the reference numeral 10 will be described.

Figure 2:
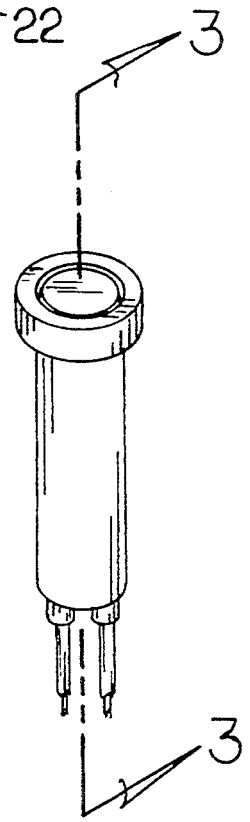
FIG. 2 is an enlarged perspective view of the fixed switch of FIG. 1.
Figure 3:
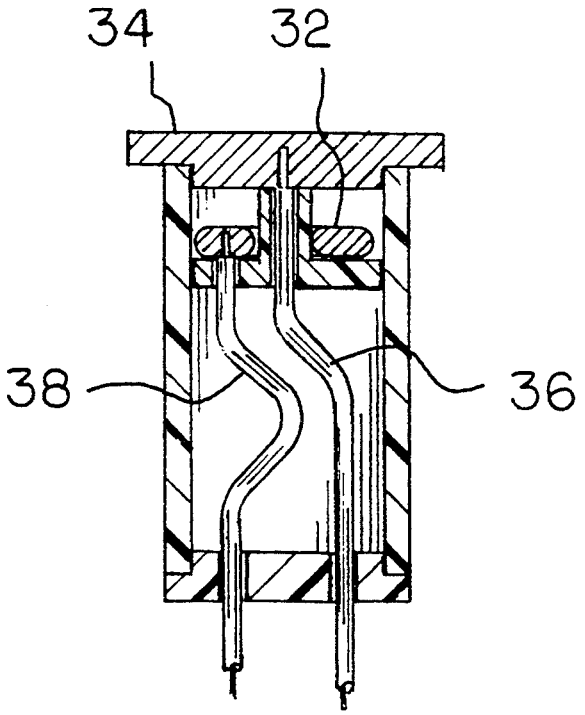
FIG. 3 is a sectional view taken along line 3—3 of FIG. 2.
Figure 4:
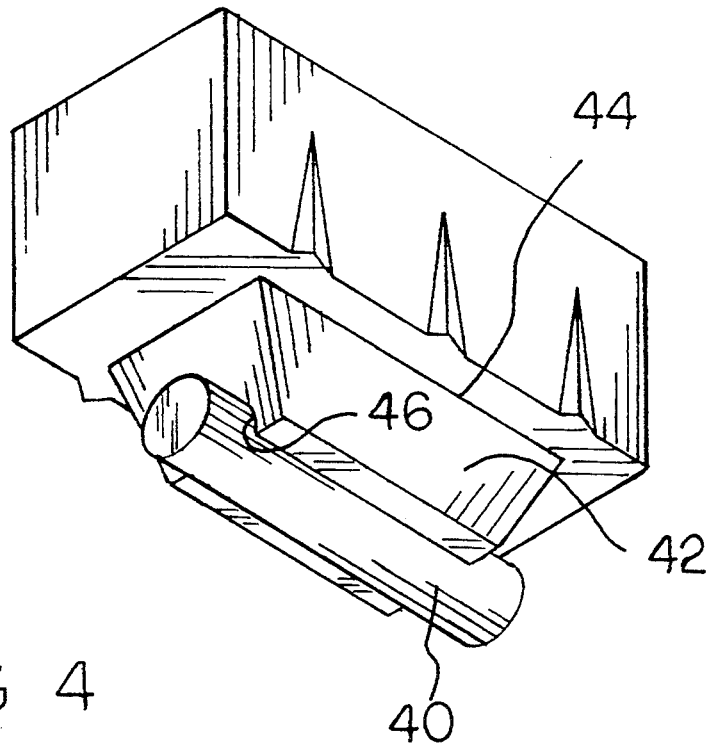
FIG. 4 is a perspective illustration of the moveable component of the system of the prior Figures.

More specifically, it will be noted that the apparatus is designed for detecting the opened and closed state of a window. It is to function preferably, as a component of a home security system. The apparatus 10 comprises, in its broadest of terms, a window assembly 12, a magnetically responsive switch 14 and a switch actuator 16. Note FIGS. 1 as well as FIGS. 2 through 4.

More specifically, the window 12 has a peripheral frame 20 defining an opening with a lower sill 22 having a free upper surface 24 and an associated window 26 slidable within the opening between an upper open orientation and a lower closed orientation. The window 12 also has a free lower surface 28 adaptable to be in operative contact with the upper surface 24 of the sill 22 when the window is closed.

A magnetically responsive switch 14 is secured with respect to the upper surface 24 of the sill 22. The switch 14 having a moveable component 32 and a fixed component 34 . A pair of electrical leads 36 and 38 are also provided.

One of the leads 36 is electrically coupled to the fixed component 34. The other lead 36 is electrically coupled to the moveable component. The moveable component 32 is being in an orientation out of contact with the fixed component 34 when the window is opened. It is moveable under the influence of a magnetic force into contact with the fixed component 34 when the window is closed.

The fixed and moveable components are formed of electrically conductive material whereby when moved into contact one with another an electrical circuit will be closed to send a signal that the window is closed. When moved out of contact one with another an electrical circuit will be opened to send a signal that the window is opened.

The moveable switch actuator 40 is formed as a magnet secured to the lower surface of the window. Resilient securement means 42 secure the magnet 40 in position with respect to the lower surface of the window. When the window is opened, the magnetic field is removed from the switch 14. When the window is closed the magnet will magnetically raise the second component 32 of the switch 14 into contact with the first component 34 of the switch 14.

In the primary embodiment, the resilient means include, regions 44 coupled to the bottom of the window and regions 46 formed with an arcuate configuration for holding the exterior surface of the magnet in an appropriate orientation with respect to the bottom of the window and the sill. A channel 50 is secured to the bottom of the window to encase both sides of the magnet when the window is closed.

In the primary embodiment of the invention as illustrated in FIGS. 1 through 4, the resilient means 42 is a block having an arcuate channel 46 adapted to mechanically support the magnet in proper position.

Figure 7:
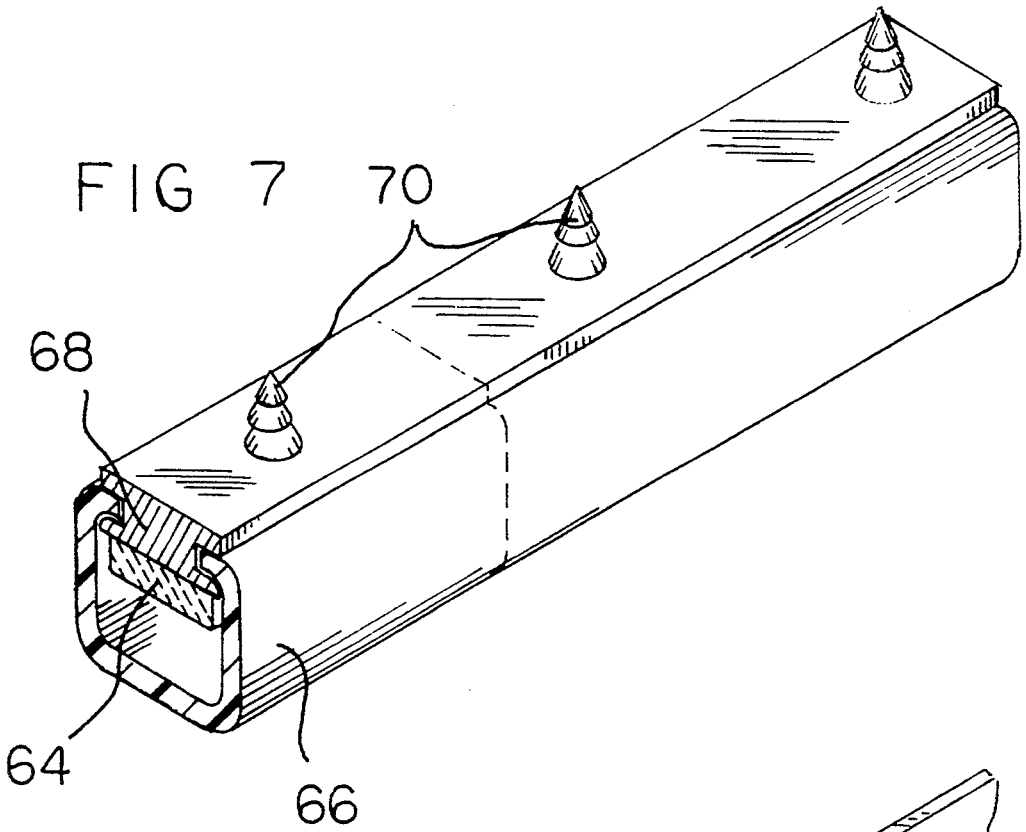
FIG. 7 is a further alternate embodiment of the magnetic assembly.

In the alternate embodiment of FIGS. 5 and 6, the resilient support means is formed of two resilient members 54. Such members have outboard ends 56 secured to a channel 58 with inboard ends 60 formed with arcuate shapes to receive the cylindrical magnet 40. The channel is secured to the bottom of the window. FIG. 7 disclosed another alternate embodiment of the invention. In such embodiment, the magnet 64 is formed as a plate and further including a channel 66 of resilient weather stripping material encasing the magnet. An intermediate plate 68 with upwardly directed pins 70 functions to secure the magnet 64 and channel 66 to the lower surface of the window.

Figure 8:
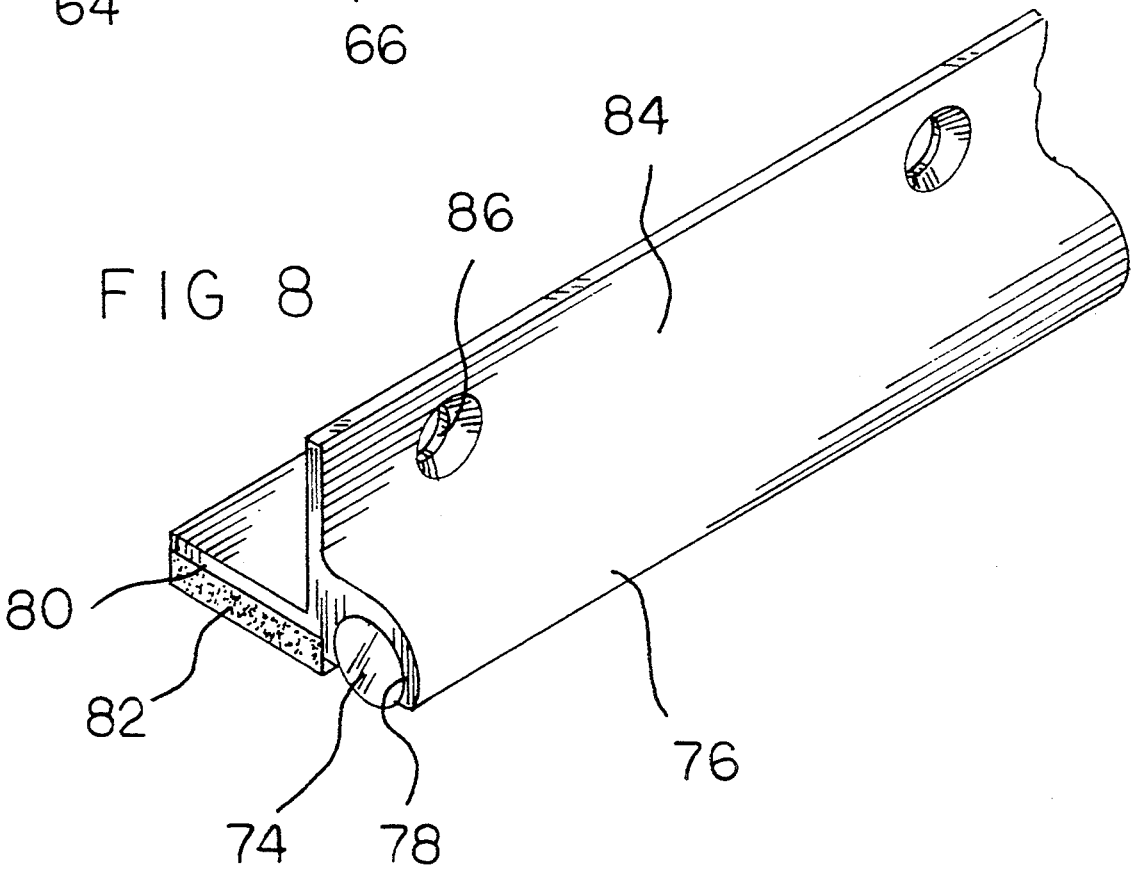
FIG. 8 is yet a further alternate embodiment of the magnetic assembly.

The apparatus as set forth in claim 6 and further in the last embodiment of the invention, as shown in FIG. 8, the magnet 74 is formed as a cylinder. The support member 76 has a profile which includes an arcuate recess 78 for receiving the magnet. The support member also has a laterally offset space for receiving a linear piece of weather stripping material 82. The support means further includes a vertical support member 84 with apertures 86 for coupling to the window. The support member is of limited resilience to allow mounting and dismounting of the magnet 74 therein.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. Apparatus for detecting the opened and closed state of a window as a component of a home security system comprising, in combination:

a window having a peripheral frame defining an opening with a lower sill having a free upper surface thereof and an associated window vertically slidable within the opening between an upper open orientation and a lower closed orientation, the window having a free lower surface adaptable to be in operative contact with the upper surface of the sill when the window is closed;

a magnetically responsive switch secured with respect to the upper surface of the sill, the switch having a moveable component and a fixed component with a pair of electrical leads, one of the leads electrically coupled between the fixed component and the other lead electrically coupled to the moveable component, the moveable component being in an orientation out of contact with the fixed component when the window is opened but moveable upwardly under the influence of a magnetic force into contact with the fixed component when the window is closed, the fixed and moveable components being formed of electrically conductive material whereby when moved into contact one with another and electrical circuit will be closed to send a signal that the window is closed but when moved out of contact one with another an electrical circuit will be opened to send a signal that the window is opened; and a moveable switch actuator formed as a magnet releasably secured to the lower surface of the window with resilient means to releasably secure the magnet in position to the lower surface of the window whereby when the window is opened to a raised position the magnetic field is removed from the switch but when the window is closed to a lowered position the magnet will, magnetically raise the second component of the switch into contact with the first component of the switch, the resilient means including regions coupled to the bottom of the window and regions formed in an arcuate configuration for holding the exterior surface of the magnet in an appropriate orientation with respect to the bottom of the window and the sill.

2. Apparatus for detecting the opened and closed state of a window as a component of a home security system comprising:

a window having a peripheral frame defining an opening with a lower sill having a free upper surface thereof and an associated window vertically slidable within the opening between an upper open orientation and a lower closed orientation, the window having a free lower surface adaptable to be in operative contact with the upper surface of the sill when the window is closed;

a magnetically responsive switch secured with respect to the upper surface of the sill, the switch having a moveable component and a fixed component with a pair of electrical leads, one of the leads electrically coupled between the fixed components and the other lead electrically coupled to the moveable component, the movable component being in an orientation out of contact with the fixed component when the window is opened but moveable upwardly under the influence of a magnetic force into contact with the fixed component when the window is closed, the fixed and moveable components being formed of electrically conductive material whereby when moved into contact one with another an electrical circuit will be closed to send a signal that the window is closed but when moved out of contact one with another an electrical circuit will be opened to send a signal that the window is opened; and a moveable switch actuator formed as a magnet releasably secured to the lower surface of the window with securement means to releasably secure the magnet in position to the lower surface of the window whereby when the window was opened the magnetic field is removed from the switch but when the window is closed the magnet will, magnetically raise the second component of the switch into contact with the first component of the switch, the securement means including regions coupled to the bottom of the window and regions for holding the exterior surface of the magnet in an appropriate orientation with respect to the bottom of the window and the sill.

3. The system as set forth in claim 2, wherein the securement means is a block having an arcuate channel adapted to mechanically support the magnet in proper position.

4. The apparatus as set forth in claim 2, wherein the securement means is formed of two resilient members.

5. The apparatus as set forth in claim 2, wherein the magnet is formed as a plate and further including a channel of resilient weather stripping material encasing the magnet.

6. The apparatus as set forth in claim 5 and further including a rigid strip with pins for coupling to the lower surface of the window.

7. The apparatus as set forth in claim 6 and further including linear recesses in the plate for supporting the weather stripping material.

8. The apparatus as set forth in claim 2 wherein the securement means includes a bracket having an essentially semicircular recess for receiving the magnet and a laterally offset space for receiving a linear piece of weather stripping material.

9. The apparatus as set forth in claim 8 wherein the securement means further includes a vertical support member with apertures for coupling to the window.

* * * * *